US006831571B2

(12) United States Patent
Bartel

(10) Patent No.: US 6,831,571 B2
(45) Date of Patent: Dec. 14, 2004

(54) LOGGING DEVICE DATA DUMP PROBE

(75) Inventor: Roger P. Bartel, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 429 days.

(21) Appl. No.: 09/732,286

(22) Filed: Dec. 7, 2000

(65) Prior Publication Data

US 2001/0029780 A1 Oct. 18, 2001

Related U.S. Application Data

(60) Provisional application No. 60/172,935, filed on Dec. 21, 1999.

(51) Int. Cl.[7] ..... G01V 1/00

(52) U.S. Cl. ..... 340/854.6; 324/303; 166/339

(58) Field of Search ..... 340/854.6, 853.9, 340/854.3, 855.1, 853.3; 166/339; 324/303

(56) References Cited

U.S. PATENT DOCUMENTS

| | | | | |
|---|---|---|---|---|
| 3,967,201 A | | 6/1976 | Rorden | 325/28 |
| 4,216,536 A | * | 8/1980 | More | 367/83 |
| 4,736,204 A | * | 4/1988 | Davison | 340/853.1 |
| 5,521,592 A | * | 5/1996 | Veneruso | 340/854.8 |

FOREIGN PATENT DOCUMENTS

| | | | |
|---|---|---|---|
| EP | 0911739 A2 | 4/1999 | G06F/13/38 |
| EP | 0973126 A1 | 1/2000 | G06K/10/07 |
| GB | 2180124 A | 3/1987 | E02D/1/04 |
| GB | 2334982 A | 9/1999 | 47/1 |
| GB | 2346509 A | 8/2000 | E21B/47/12 |
| WO | WO0104661 A2 | 1/2001 | |

* cited by examiner

*Primary Examiner*—Michael Horabik
*Assistant Examiner*—Hung Dang
(74) *Attorney, Agent, or Firm*—Conley Rose, P.C.

(57) ABSTRACT

A method and apparatus for transferring data from a logging tool to a surface computer that involves attaching a stand-alone data dump device to the logging tool after the logging tool has gathered data about downhole parameters. After attaching the data dump device, data contained in a memory of the logging tool is copied to a memory of the data dump device. In one embodiment, once data copying between the logging tool and data dump device is complete, the data dump device is disconnected from the logging tool and connected to a surface computer which reads the data previously copied to the data dump device. A second embodiment of the data dump device has a radio frequency communication link between the surface computer and the data dump device to allow a wireless communication between the surface computer and the data dump device and/or logging tool.

21 Claims, 6 Drawing Sheets

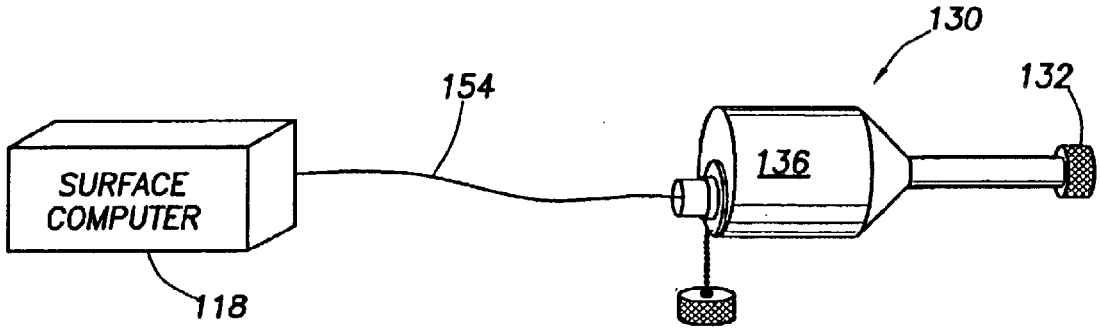
FIG.6
FIG.8
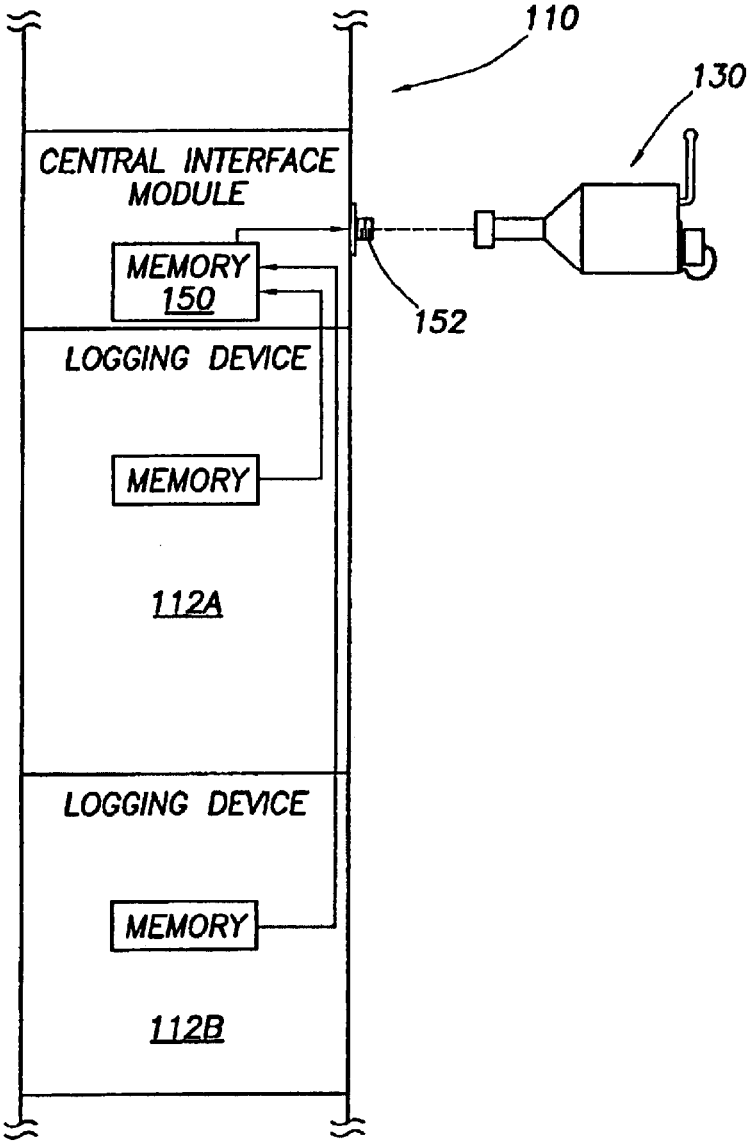

LOGGING DEVICE DATA DUMP PROBE

CROSS-REFERENCE TO RELATED APPLICATIONS

This application claims the benefit of Provisional Application titled "Logging Device Data Dump Probe" filed Dec. 21, 1999, Ser. No. 60/172,935.

STATEMENT REGARDING FEDERALLY SPONSORED SEARCH OR DEVELOPMENT

Not Applicable.

BACKGROUND OF THE INVENTION

1. Field of the Invention

The present invention relates generally to logging while drilling (LWD) technologies. More specifically, the invention relates to downloading data stored in the memory of LWD devices. More specifically still, the invention relates to a data dump probe that downloads data from LWD devices.

2. Background of the Invention

Modern petroleum drilling and production operations demand a great quantity of information related to parameters and conditions down hole. Such information typically includes characteristics of the formations traversed by the well bore, in addition to data relating to the size and configuration of the bore hole itself. The collection of information relating to characteristics of formations down hole is commonly referred to "logging." Logging has been known in the industry for many years as a technique for providing information regarding the particular formation being drilled and can be performed by several methods.

One such logging method is convention wire-line logging. In wire-line logging a probe is lowered into the bore hole after some or all of the well has been drilled, and the probe is used to determine certain characteristics in the formations traversed by the bore hole or the bore hole itself. While wire-line logging is useful in assimilating information about down hole formations, before a wire-line logging tool can be run in the well bore, the drill string and bottom hole assembly must first be removed resulting in considerable cost and loss of drilling time for the driller (who typically is paying daily fees for the rental of equipment).

Because of the limitations associated with wire-line logging, there recently has been an increasing emphasis on the collection of data during the drilling process itself. By collecting data during the drilling process, without the necessity of removing the drilling assembly to insert a wire-line logging tool, data regarding the down hole formations can be collected more economically. Data collected during the drilling operation must either be relayed to the surface or stored until the logging device is brought back to the surface. Given the relatively slow data rates achievable in communicating from down hole logging and measuring devices to surface computers, storing the data collected may be the only option for the majority of data.

Several types of logging devices, or LWD tools, are used by the industry and each tool may require varying amounts of internal memory. For example, a "gamma" tool requires comparatively little memory; whereas, an acoustic or sonic tool may require a significant amount of memory, approaching 250 Megabytes, to have the capability to store all the information required during a drilling run. Other down hole tools may also include a resistivity tool, a caliper tool, and a directional tool. Information gathered by the directional tool is needed relatively real time with the drilling process, and therefore, the information gathered by a directional tool is generally sent from down hole to surface computers using known techniques such as by transmitting mud pulses to the surface at approximately a 1 Hz baud rate.

On a tool that stores data from a drilling run, some method must exist to extract the data stored in the tool. Currently, information obtained by a LWD tool is stored in memory within the tool itself until the logging tool is brought to the surface. Upon being lifted to the surface, the data is extracted. Referring to FIG. 1, there is depicted a prior art structure for downloading data stored in the memory of a logging tool. Shown in FIG. 1 is a drill string 10 which comprises a LWD tool 12 and drill bit 14, a drilling table 16, surface computer 18, download cable 20 and connector 22.

The LWD tool 12 is raised to the surface of the earth after a drilling run. Once the LWD tool 12 is raised slightly above the drill table 16, an operator stretches download cable 20 to the LWD tool 12 and thereby couples the surface computer 18 to the LWD tool 12 via the connector 22. While this operation seems relatively simple, several practical problems exist.

On most drilling rigs, especially drilling platforms on the ocean, space is a commodity and therefore the surface computer may not, indeed most likely is not, close to the LWD tool 12. Another consideration is the environment of the download process. Drilling rigs and drilling platforms, especially on the drilling table 16, are generally explosive environments. Small sparks could create a fire or explosion. The computer may potentially create sparks, and thus may not be permitted on the rig floor. Consequently, the surface computer may be several floors and hundreds of feet from the drilling table 16. Further, plugging an unplugging electrical connectors may created sparks in the potentially explosive environments and, for this additional reason, use of download cables 20 on or near the drilling table 16 have the added disadvantage of a potential fire or explosion hazard.

As one of ordinary skill in the art will realize, the information rate a cable may accurately transmit decreases as the length of the cable increases. This means, for the system described in FIG. 1, that as the surface computer is placed further from the logging tool, the download rate decreases and therefore the time required to download increases as the cable length increases.

An additional factor that decreases data download rates is electrical noise. A drilling rig has many pumps and motors associated with the drilling process which create significant electrical noise. Because the download cable 20 winds in and around the drilling rig to get to the surface computer, it becomes an antenna for receiving electrical noise. Electrical noise further decreases the data rate of the cable. Given all these conditions, the typical data rate for the cable 20 of the related art may be at or near 80 kilo-baud.

Further, with data rates associated with the related art methods of downloading information in the 80 kilo-baud range, downloading information from a memory intensive logging device, e.g. an acoustic probe, may take in excess of thirty minutes. Various techniques exist to insure that no data errors occur in the digital communication, but these techniques are not infallible. On occasion, a download may occur having errors that precipitate a second download of the same information, and possibly even a third, until the information is exchanged error free. In these instances when an error occurs and the process of downloading is repeated, significant rig time is lost to the download process.

As the demand for LWD data increases many companies have begun placing multiple logging devices in the drill string for measuring multiple parameters as part of the logging while drilling process. The problems experienced with the download cable 20 as described in reference to FIG. 1 increase substantially as the number of logging devices, with internal memories that require downloading on the surface, increase. Referring to FIG. 2, there is indicated one possible structure for downloading data contained in multiple logging devices. As indicated in the figure, the envisioned method is to have a breakout box 15 somewhere near the drilling table 16, and from this breakout box having an individual download cable 20A, 20B, 20C for each and every logging device in the drill string. Each download cable 20A, 20B, 20C has its respective connector 22A, 22B, 22C. Physically, this arrangement increases the hazards associated with downloading the information from a single logging device. That is, using this method to download the data from the logging devices requires multiple cables strewn about the drilling table 16. The danger created by the download cables 20A, 20B, 20C is increased by the fact that some of the logging devices 12 may be many feet in length and therefore the download cable 20, when connected to an uppermost logging device, e.g. 12A, would be draped either down to the drilling table 16 or to the breakout box 15 when a lower most logging device connector becomes accessible for connection thus creating tripping hazards.

Based on the foregoing, it would be desirable to have a method and device that eliminates the need for a download cable, and in the case of multiple logging devices, multiple download cables, and which further addresses the safety issues generally associated with downloading data from logging devices on a drilling rig or drilling platform.

BRIEF SUMMARY OF THE INVENTION

The problems noted above are solved in large part by a stand-alone data download device. In one embodiment, the data download device electrically couples to a LWD tool and downloads logging data stored in memory of the LWD tool to memory within the data download device. After the information is exchanged between the LWD tool and the data download device, the data download device can be de-coupled from the LWD tool and physically carried to a location near the surface computer where logging information, now contained in memory of the data download device, can be read by the surface computer. In the situation where multiple logging devices exist on the drill string, multiple data download devices could be used such that substantially simultaneous downloading could occur from the logging devices.

In another embodiment of the invention the data download device includes a radio frequency (RF) transmitter/receiver and the surface computer likewise has a RF transmitter/receiver. Therefore, the data download device and the surface computer could communicate while the data download device is electrically coupled to the logging device. In this embodiment it is envisioned that the RF link is used for either relaying data extracted from the logging device, or, is used as a control and monitoring feature whereby the surface computer initiates and monitors downloads between the LWD tool and the data download device.

BRIEF DESCRIPTION OF THE DRAWINGS

For a detailed description of the preferred embodiment of this invention, reference will now be made to the accompanying drawings in which:

FIG. 6 depicts a data dump probe coupled to a surface computer; and

FIG. 8 shows use of the invention in combination with a central interface module.

NOTATION AND NOMENCLATURE

Figure 1:
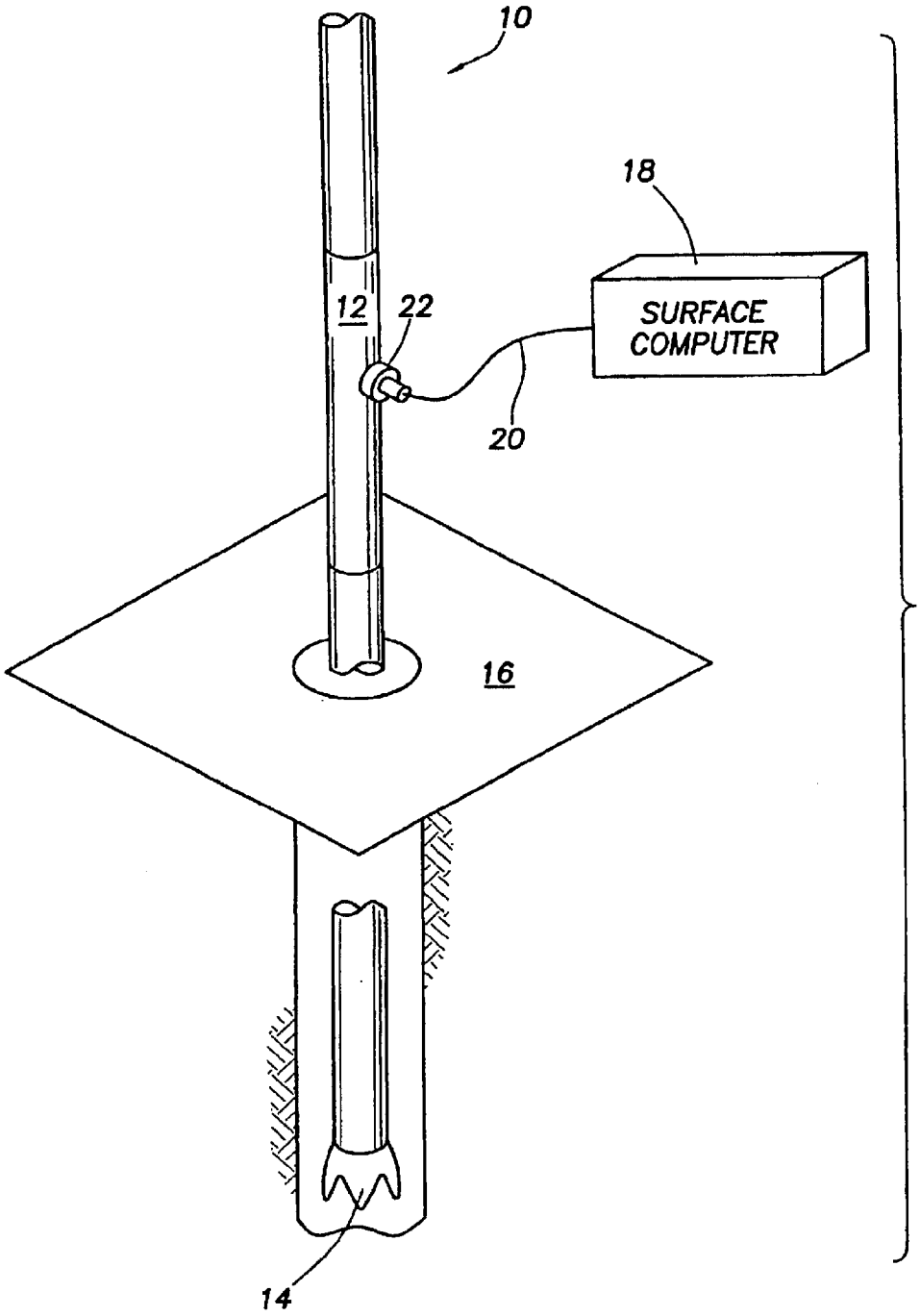
FIG. 1 (PRIOR ART)
FIG. 1 shows a prior art drilling assembly including a logging device.
Figure 2:
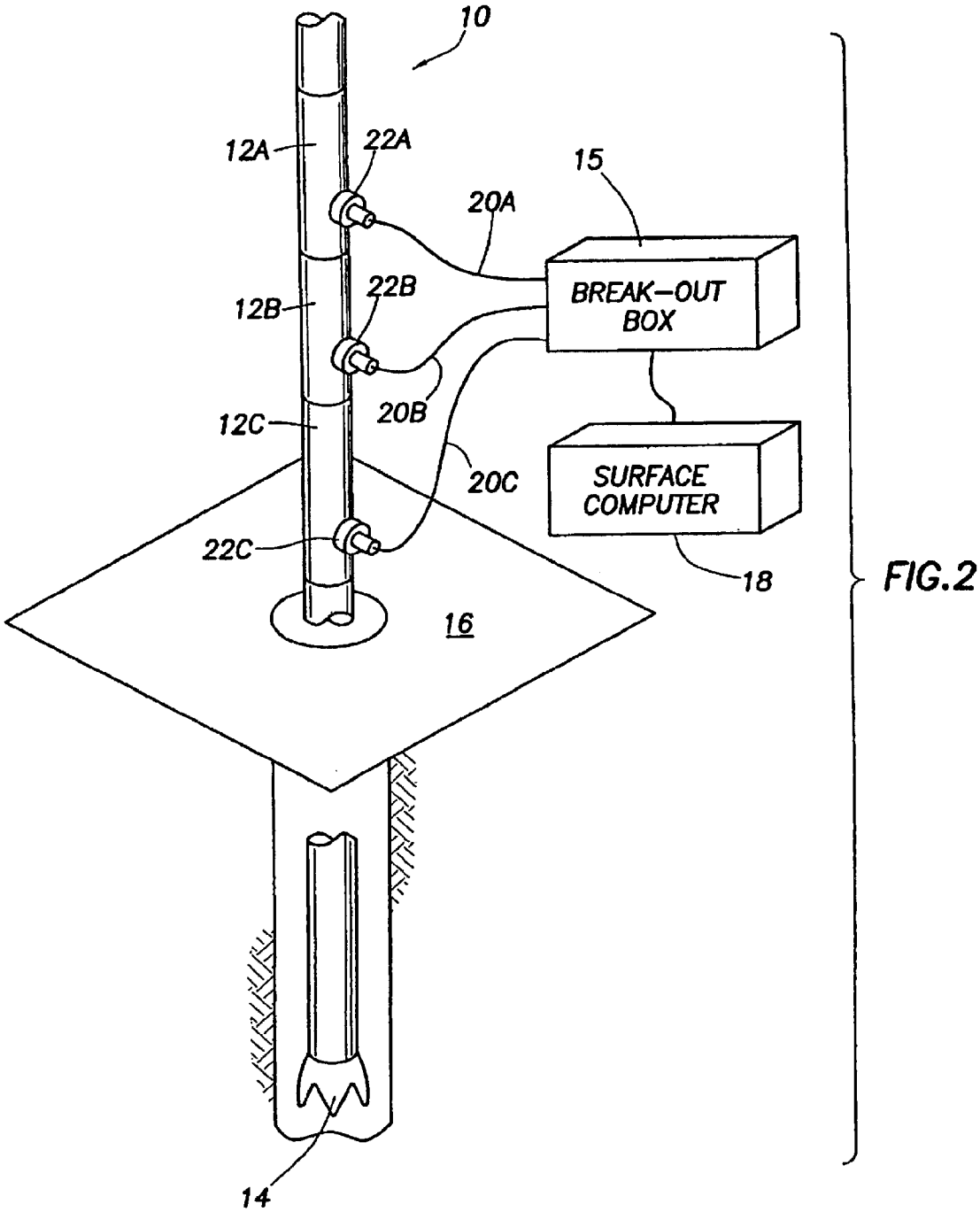
FIG. 2 shows a configuration for downloading information from multiple logging devices.

Certain terms are used throughout the following description and claims to refer to particular system components. As one skilled in the art will appreciate, different companies may refer to a component by different names. This document does not intend to distinguish between components that differ in name but not function. In the following discussion and in the claims, the terms "including" and "comprising" are used in an open-ended fashion, and thus should be interpreted to mean "including, but limited to . . . ." Also, the term "coupled" or "couples" in the electrical context is intended to mean either an direct or indirect electrical connection.

CATALOG OF ELEMENTS

As a aide to correlating the terms of the claims to the exemplary drawings, the following catalog of elements is provided:

10 drill string
12 LWD tool
14 drill bit
15 breakout box
16 drilling table
18 surface computer
20 download cable
22 connector
110 drill string
112 LWD tool
114 drill bit
116 drilling table
118 surface computer
130 data download device
132 logging device connector
134 surface computer connector
136 enclosure
138 radio frequency antenna
140 dump probe memory
142 processor
144 input/output logic
146 RF link
148 central interface module
150 CIM memory
152 CIM connector
154 surface computer download cable
156 surface computer RF link

DETAILED DESCRIPTION OF THE PREFERRED EMBODIMENTS

Figure 3:
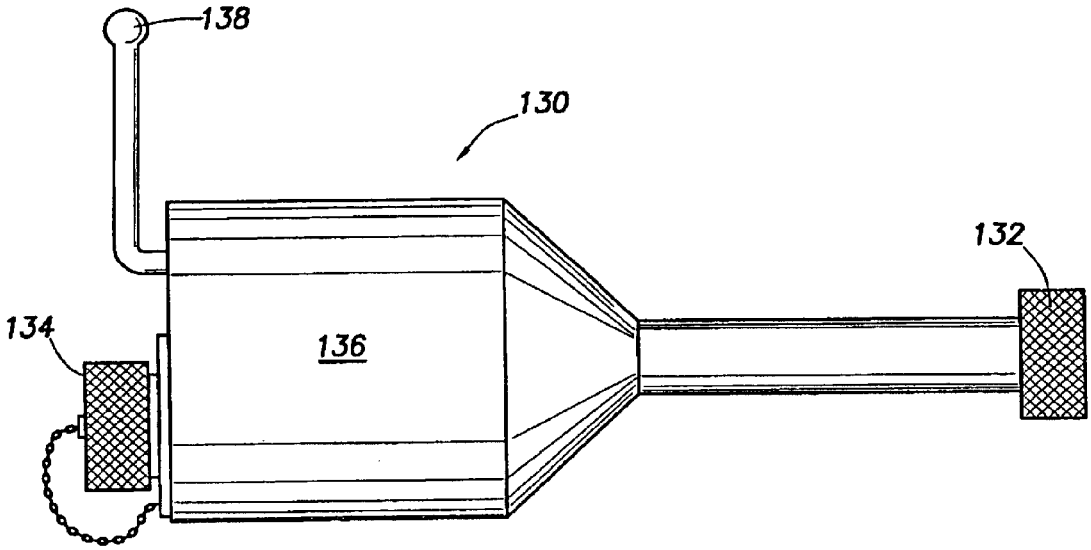
FIG. 3 shows a side view of one embodiment of the data download device.
Figure 5:
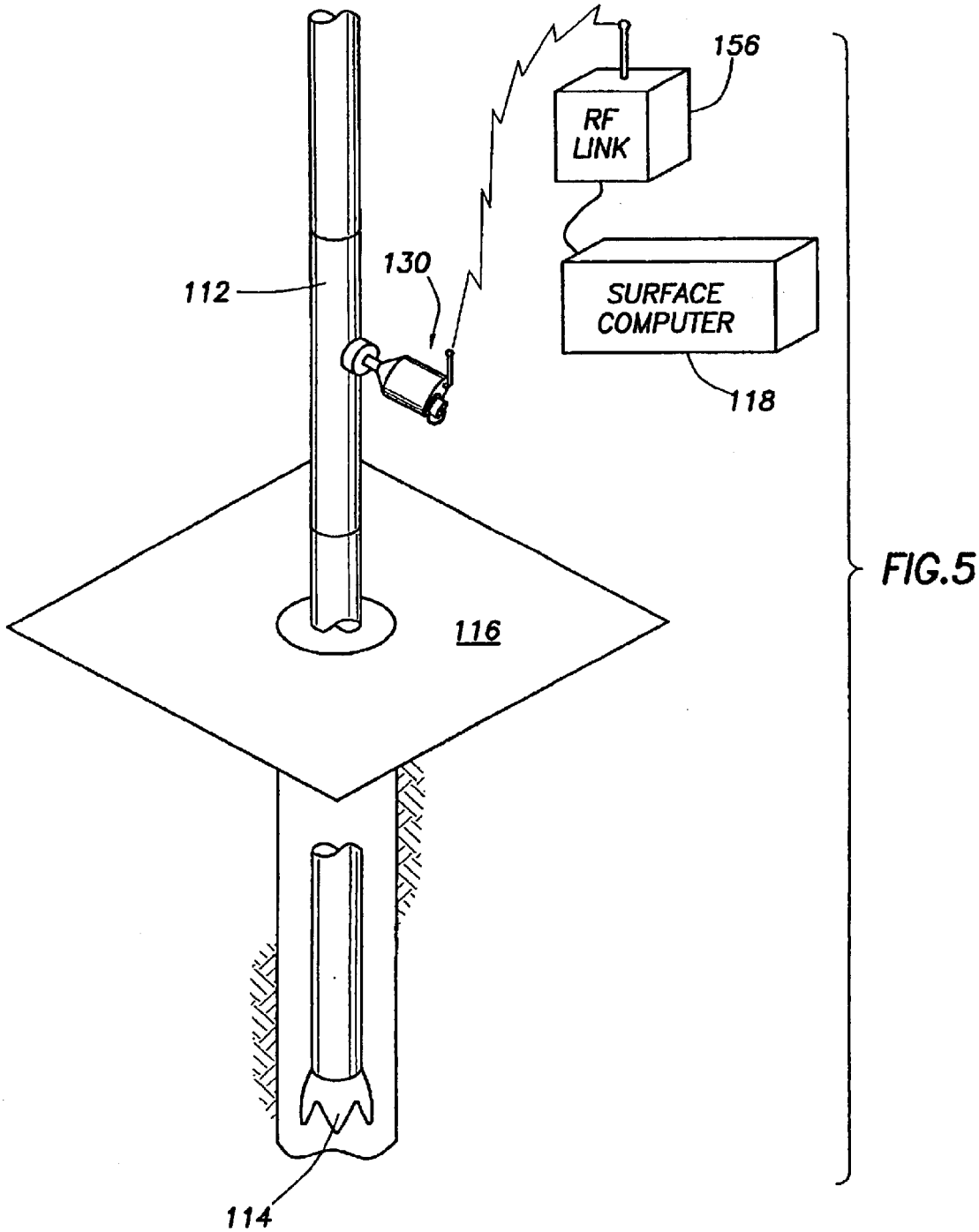
FIG. 5 shows use of the invention in a drill string with a single logging device.
Figure 7:
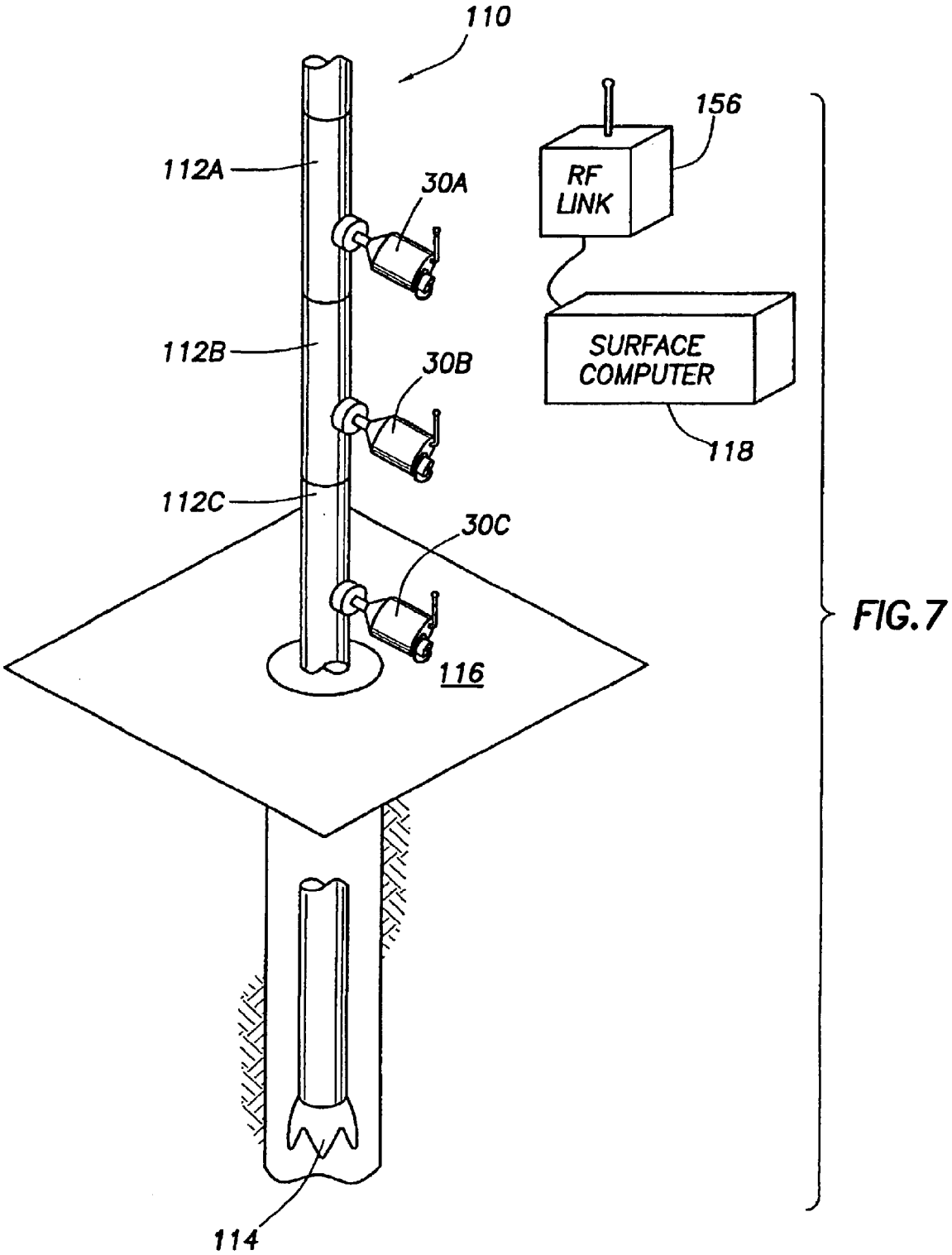
FIG. 7 shows use of the invention in a drill string assembly having multiple logging devices.

Referring now to FIG. 3, an exemplary embodiment of a data download device 130 is described. The data download device 130, also referred to herein as a dump probe, has many components including two electrical connectors—logging device connector 132 and surface computer connector 134. Logging device connector 132 is used to both physically connect the data download device 130 to a logging device, as well as to couple the two devices to facilitate data exchange. Connector 134 allows data download device 130 to couple to surface computer 118 (not shown in FIG. 3, see FIG. 6) to allow data exchange between those two devices. FIG. 5 shows data download device 130 physically connected to a logging device 112.

Referring still FIG. 3, enclosure 136 houses the data dump probe 130. It is within enclosure 136 that the electronic circuits and components necessary to copy data from a LWD tool 112 to memory within the data dump probe 130 reside. Enclosure 136 could be made of any suitable material; however, as indicated generally in the figures, enclosure 136 not only houses the electronics required for the data dump device but also physically supports the components of the data dump device when attached to a LWD tool 112. For this reason, the enclosure 136 could be made of steel or resilient plastic. The data dump probe 130 may be used in explosive environments and for this reason the enclosure 136 may be made from brass such that if it was dropped it would not spark.

Logging device connector 132 is designed to physically couple with a complimentary connector on the LWD tool 112. This connector could be any suitable connector for making the electrical connection and supporting the dump probe 130. FIG. 3 also shows surface computer connector 134. As the name implies, it is through this connector 134 that the electronic components of the dump probe 130 couple to a surface computer such that data downloaded from a LWD tool to the dump probe 130 can be furthered transferred from the memory of the data dump probe to the surface computer 118. Connector 134 is shown to have a cap and keeper chain; however, these are not required elements. Inasmuch as the data dump probe 130 may be used in a relatively dirty and explosive environment, the cap on connector 134 may serve a dual purpose. The first purpose would be to keep drill cuttings, drilling fluid, grease and other foreign substances out of the electrical connections housed under the cap. Secondly, in an explosive environment, to be rated as intrinsically safe, a device must not emit energy above a threshold amount during operation and this energy limit may be in the milli-Joule range. Therefore, the cap over connector 134 acts as a shield to limit the amount of energy, if any, that may be released by exposed electrical connectors within the connector 134.

Figure 4:
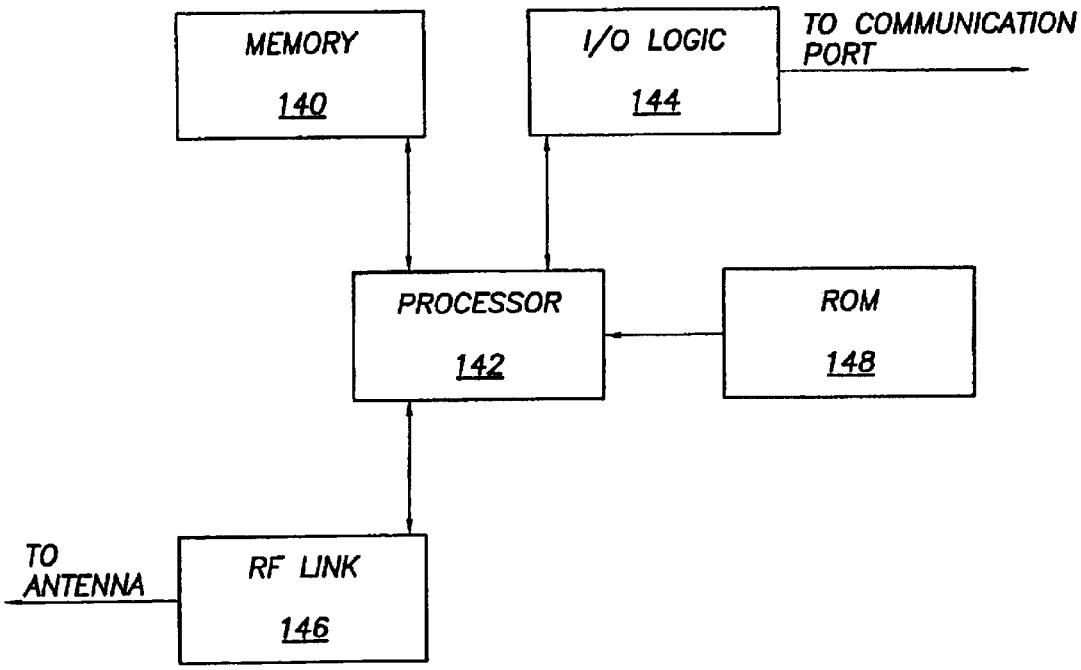
FIG. 4 shows a block diagram of the internal components of the data download device.

One of the primary purposes of the data dump probe 130 is to copy logging data from a LWD tool 112. More specifically, one function is to copy data stored in a memory of a LWD tool 112 to a data dump probe memory 140. Referring to FIG. 4 there is indicated a block diagram of one configuration of the data dump probe 130. In the preferred embodiment of FIG. 4, the dump probe 30 includes a processor 42 which controls copying of data from the LWD tool 112. The data dump probe may also verify that data in data dump probe matches data in the LWD tool. Processor 142 preferably couples to read only memory (ROM) 148 which contains programs executed by the processor 142 to complete necessary operations. Further, processor 142 couples to memory 140 in which data copied from the LWD tool 112 is placed for storage until the data can be sent to a surface computer 118. To facilitate communication to and from the LWD tool, processor 142 couples to an input/output logic 144. Input/output logic 144 provides necessary signal amplification and may further facilitate implementing the protocol for data communication used between the data dump device 130 and the LWD tool 112. For example, the protocol with which the data dump device 130 and the LWD tool 112 communicate could be RS-232, RS-485, or some other non-standard or proprietary communication protocol.

As one skilled in the art will appreciate, memory 140 requires sufficient capacity to store data from even the most memory intensive LWD tool. Given the current state of the art in LWD tools, the data dump probe 130 may need as much as a gigabyte of memory. This memory capacity requirement may increase as the volume of information stored in LWD tools increases. This memory may comprise any suitable type of memory, for instance, some type of NAND FLASH memory, or possibly a plurality of PCMCIA memory cards may be used to withstand the harsh environments encountered at the rig site. If using PCMCIA type memory, or any memory that may be physically disconnected from the data dump probe 130, it is possible to move the data stored in the data dump probe 130 to the surface computer 118 by moving the memory physically from the data dump probe 130 and placing it in a receiving device such that the surface computer 118 can read the data directly.

One of ordinary skill in the art will appreciate that many possible configurations of electrical components could be used to complete the task of downloading information from a LWD tool 112 to the data dump device 130 with the respective protocol used. The electronics could be as unsophisticated as a microcontroller, in which case the ROM, input/output logic, and possibly the memory could all reside on a single component. Likewise, the electronics in the data dump probe 130 could be implemented as a full-scale microprocessor. As the speed and capabilities of the internal processor increase, capabilities for data manipulation within the data dump probe increase.

Part of the significant advantage of the data dump probe 130, over a long connector cable 20 of the prior art, is that the data dump probe 130 is relatively close to the LWD tool 112. Therefore, the connection between the data dump probe 130 and the LWD tool 112 is relatively short. Indeed, given the relatively small size of the data dump probe 130, it may be possible to place the electronics and memory of the data dump probe 130 within feet or even inches of the electronics and memory of the LWD tool 112. Given this relatively short distance, higher data rates over the desired protocol are achievable. However, higher data rates are not the only advantage of this invention, but the advantages may also include fewer cables on the drilling rig, increased ability to monitor the download process, and easier implementation of downloading data with or without increased data transfer rates.

Further, given the possibly explosive environment in which the data dump probe 130 may be used, other methods of coupling the data dump probe 130 to the LWD tool 112 may be advantageous. For example, some form of optical or fiber optic connection, or possible even magnetic coupling may be used. These methods of coupling reduce the likelihood of sparks associated with typical conductor to conductor coupling.

Referring again to FIG. 3, a radio frequency (RF) antenna 138 preferably attaches to enclosure 136. This antenna 138, in combination with another antenna and RF link 146 coupled to the surface computer 118 (see FIG. 5), permit RF communication between the data dump device 130 and the surface computer 118. Therefore, the data dump device 130 and the surface computer 118 could communicate while the data dump device is coupled to the logging device. The radio frequency link is used for either relaying data extracting from the logging device, or may be used as a control and monitoring feature whereby the surface computer initiates and monitors downloads between the LWD tool and the data download device.

In a drilling operation, one or more logging devices 112 preferable are included as part of the drill string 110. These logging devices, as well as drill bit 114, are lowered into a bore hole and the drilling operation begins. As the drilling operation proceeds, each logging device performs its respective logging function. For example, the logging devices may perform acoustic, nuclear or gamma formation measurements. After a certain amount of drilling, the drill string may be raised to the surface to change drill bits, or possibly even a dedicated lift to download information from the logging devices. Assuming the drill string has multiple logging devices, as the first logging device is raised to be positioned slightly above the drilling table 116, a first data download device 130A is connected to a connection port on the first logging device. The drill string is further raised until the connection port for the second logging device is slightly above the drilling table. A second data download device 130B is connected to the second logging device. The drill string is raised again and a third data download device 130C is attached. This sequential raising and connecting is repeated until each logging device has connected to it a data download device 130.

It is possible to configure a series of LWD tools for use on a drill string such that each LWD tool need not have an individual receptacle for electrical connection. Referring to FIG. 8 there is shown a drill string 110 having two LWD tools 112A and 112B and further showing a central interface module (CIM) 148 coupled to each logging device 112A and 112B. In this embodiment, the central interface module gathers data collected by each logging device 112A and 112B and stores it in a memory 150 in the CIM 148. Copying data from the logging device memories to the CIM memory 150 could be done either substantially simultaneously with the gathering of data down hole, or could be transferred during raising the drill strings to the surface. Upon being raised to the surface, connector 152 of the CIM 148 would be available to connect to a data dump device 130. In this way, a single dump device 130 could download data from multiple logging devices. One of ordinary skill in this art will realize that a drill string 110 may have any combination of LWD tools and therefore it may be possible that one or more stand alone tools, e.g. an acoustic tool, could be placed in a drill string with multiple LWD tools that could attach to a CIM module. In this configuration, multiple data download devices 130 could be used to download data from the LWD tools: a dedicated download device 130 for each memory intensive LWD tool; and a dedicated download device 130 could be used for each CIM module in any combination in the drill string.

When data downloads are completed, the sequence of attaching the multiple data download devices is reversed and each device is removed as the drill string is lowered back into the bore hole. After removing each data download device, all devices are physically transported to a location at or near the surface computer 118 where each data download device 130 is coupled to the surface computer so the logging data contained therein can be transferred to the surface computer 118 for analysis.

The above discussion is meant to be illustrative of the principles and various embodiments of the present invention. Numerous variations and modifications will be apparent to those skilled in the art once the above disclosure is fully appreciated. For example, it may be that each data download device has a relatively simple user interface on one face of the enclosure 136. From this user interface, an operator connecting the data download device to a particular LWD tool would enter the type device to which the data download device is being attached and start the process through keystrokes. Likewise, it has been disclosed that the data download device 130 is physically supported by logging device connector 132. It would be within the contemplation of this invention that the LWD tool connector 132 not support the weight of the data download device 130, but rather, the device could be strapped, or possibly held in place by magnets, on an outer wall of a LWD tool. If such was the case, a short cable could run from the electrical components of the data download device 130 to the LWD tool connector 132. Further, many possible embodiments for the electrical components necessary to facilitate transferring data from memory in the LWD tool to a memory in the data download device exist. These embodiments could range from anything as simple as a low-end microcontroller that merely initiates the data transfer, to a full-scale microprocessor which could actually process, to some extent, the data as it transfers between the logging device and the data download device, and all would be within the contemplation of this invention. Finally, while dedicated logging device connectors and surface computer connectors have been described, the functionality may be combined into the same connector. It is intended that the following claims be interrupted to embrace all such variations and modifications.

I claim:

1. A method of transferring data from a logging while drilling (LWD) tool to a surface computer, comprising:

making measurements with the LWD tool thereby creating data;

raising the LWD tool to the surface;

coupling a data dump device to the LWD tool after the LWD tool is at the surface;

copying the data from a LWD tool memory to a data dump device memory; and downloading the data from the data dump device memory to a surface computer.

2. The method as defined in claim 1 further comprising communicating between the surface computer and the data dump device over a radio frequency link.

3. The method as defined in claim 1 wherein the copying step further comprises verifying data in the dump device memory matches data in the LWD tool memory.

4. The method as defined in claim 1 wherein the downloading step further comprises:

coupling the data dump device to a surface computer; and copying data stored in the data dump device memory to the surface computer.

5. A method of transferring data from multiple logging while drilling (LWD) tools to a surface computer, comprising:

placing multiple LWD tools in a drill string bottom hole assembly, each LWD tool making measurements and creating data;

raising the multiple LWD tools to the surface;

coupling multiple data dump devices one each to the multiple LWD tools after each LWD tool is at the surface;

copying data from each LWD tool memory to its respective data dump device memory; and downloading the data from the each data dump device memory to a surface computer.

6. A method of transferring data from a logging while drilling (LWD) tool to a surface computer, comprising:

placing a plurality of LWD tools in a drill string bottom hole assembly;

connecting a group of at least two of the plurality of LWD tools to a central interface module (CIM) within the drill string;

drilling while the plurality of LWD tools make measurements thereby creating data;

gathering data created by the group of LWD tools to a CIM memory;

raising the plurality of LWD tools to the surface;

coupling a data dump device to the CIM;

copying data from the group of LWD tools stored in the CIM memory to the data dump device memory; and downloading the data in the data dump device memory to a surface computer.

7. A method of transferring data from a logging while drilling (LWD) tool to a surface computer, comprising:

drilling while the LWD tool makes measurements thereby creating data;

raising the LWD tool to the surface;

coupling a data dump device to the LWD tool;

copying the data from a LWD tool memory to a data dump device memory;

downloading the data from the data dump device memory to a surface computer;

communicating between the surface computer and the data dump device over a radio frequency link; and monitoring the progress of copying of data from the LWD tool memory to the dump device memory with the surface computer over said radio frequency link.

8. An apparatus that transfers data from a logging device to a surface computer, comprising:

a memory that stores a copy of data downloaded from the logging device;

a processor coupled to the memory that controls a transfer of data from the logging device to the memory;

a first communication port coupled to the processor that allows the processor to communicate with and copy data from the logging device;

a radio frequency communication device coupled to said processor;

an antenna coupled to the communication device;

wherein the combination of the antenna and communication device facilitate communication to a surface computer; and wherein the combination of the antenna and communication device are adapted to allow the surface computer to monitor and control data copying.

9. A data dump probe, comprising:

a data dump probe memory to store a copy of data downloaded from a memory of a logging device;

a processor coupled to the data dump probe memory to facilitate data transfer from the memory of the logging device;

an enclosure to house the data dump probe memory and the processor; and a first connector adapted to couple the processor to the memory of the logging device and further to attach the enclosure to said logging device.

10. The dump probe as defined in claim 9 further comprising a second connector to couple the processor to a surface computer.

11. The dump probe as defined in claim 10 wherein said first connector and second connector are the same connector.

12. The dump probe as defined in claim 9 further comprising:

a transmitter/receiver circuit coupled to said processor;

said transmitter/receiver circuit adapted to allow communication between said data dump probe and a surface computer.

13. A data dump probe, comprising:

a memory to store a copy of data downloaded from a logging device;

a processor coupled to the memory to facilitate data transfer from the logging device to said memory;

an input/logic coupled to the processor to transfer the data from the logging device;

an enclosure to house the memory, processor and input/output logic;

a first connector adapted to couple the input/output logic to a logging device memory and further to attach the enclosure to said logging device;

a transmitter/receiver circuit coupled to said processor, wherein said transmitter/receiver circuit adapted to allow communication between said data dump probe and a surface computer, wherein the transmitter/receiver circuit is adapted to allow said surface computer to monitor the data transfer from the logging device.

14. A method of transferring data between a surface computer and a logging while drilling (LWD) tool, the method comprising:

coupling a communication device to the LWD tool; and wirelessly transferring data between the surface computer and the communications device, and transferring the data between the communications device and the LWD tool; and prior to the coupling step:

drilling while the LWD tool makes measurements thereby creating data; and raising the LWD tool to a surface;

wherein transferring data further comprises:

transferring data from the LWD tool to a memory of the communication device; and transferring the data from the memory of the communication device to the surface computer.

15. A method comprising:

raising a logging while drilling (LWD) tool to a surface;

coupling a wireless communication device to the LWD tool, the wireless communication device comprising a processor coupled to a memory and a radio-frequency link; and communicating between a surface computer and the LWD tool through the radio-frequency link of the wireless communication device.

16. The method as defined in claim 15 wherein communicating between the surface computer and the LWD tool through the wireless communication device further comprises:

communicating from the surface computer to the LWD tool; and transferring data from the LWD tool to the surface computer.

17. A method comprising:

drilling while an LWD tool makes measurements thereby creating data;

raising the LWD tool to a surface of the earth;

coupling a data dump device to the LWD tool after the raising the LWD tool to the surface of the earth;

copying data from the LWD tool created during the drilling step to a removable memory device within the data dump device;

removing the removable memory device from the data dump device; and installing the removable memory device in a surface computer, thereby making available the data to the surface computer.

18. The method of transferring data between an LWD tool and a surface computer as defined in claim 17 wherein copying the data further comprises copying the data to a removable random access memory device having nonvolatile storage characteristics.

19. The method of transferring data between an LWD tool and a surface computer as defined in claim 18 further comprising copying the data to a PCMCIA card coupled to the data dump device.

20. A method comprising:

drilling while a plurality of LWD tools make measurements thereby creating data, the data gathered in a central interface module (CIM) memory;

raising the plurality of LWD tools to the surface;

coupling a data dump device to the CIM, the data dump device having a dump device memory;

copying the data in the CIM memory to the data dump device memory; and downloading the data in the data dump device memory to a surface computer.

21. A method comprising:

drilling while an LWD tool makes measurements thereby creating data;

coupling a data dump device to the LWD tool after the raising the LWD tool to the surface of the earth;

copying the data to a removable memory device within the data dump device;

removing the removable memory device from the data dump device; and installing the removable memory device in a surface computer, thereby making available the data to the surface computer.

* * * * *